United States Patent [19]

Bobo

[11] Patent Number: 4,580,946

[45] Date of Patent: Apr. 8, 1986

[54] FAN BLADE PLATFORM SEAL

[75] Inventor: Melvin Bobo, Cincinnati, Ohio

[73] Assignee: General Electric Company, Cincinnati, Ohio

[21] Appl. No.: 675,108

[22] Filed: Nov. 26, 1984

[51] Int. Cl.[4] ..... F01D 5/26; F01D 5/22

[52] U.S. Cl. ..... 416/193 A; 416/190

[58] Field of Search ..... 416/193 A, 190, 191

[56] References Cited

U.S. PATENT DOCUMENTS

| | | | |
|---|---|---|---|
| 3,295,825 | 1/1967 | Hall | 416/198 A X |
| 3,451,654 | 6/1969 | Johnson | 416/196 R X |
| 3,680,977 | 8/1972 | Rabouyt et al. | 416/190 X |
| 3,709,631 | 1/1973 | Karstensen et al. | 416/193 A X |
| 3,752,598 | 8/1973 | Bowers et al. | 416/221 X |
| 3,771,922 | 11/1973 | Tracy | 416/196 R |
| 3,918,842 | 11/1975 | Longley et al. | 416/193 A X |
| 4,029,436 | 6/1977 | Shoup, Jr. et al. | 416/193 A |
| 4,177,013 | 12/1979 | Patterson et al. | 416/193 A |
| 4,183,720 | 1/1980 | Brantley | 416/193 A |
| 4,422,827 | 12/1983 | Buxe et al. | 416/193 A |
| 4,457,668 | 7/1984 | Hallinger | 416/190 X |
| 4,494,909 | 1/1985 | Forestier | 416/193 A |
| 4,505,642 | 3/1985 | Hill | 416/193 A |
| 4,541,778 | 9/1985 | Adams | 416/193 A |

FOREIGN PATENT DOCUMENTS

| | | | |
|---|---|---|---|
| 1252763 | 12/1960 | France | 416/190 |
| 1374917 | 8/1964 | France | 416/190 |
| 1259750 | 1/1972 | United Kingdom | 416/193 A |
| 1457417 | 12/1976 | United Kingdom | 416/193 A |
| 2112466 | 7/1983 | United Kingdom | 416/193 A |

*Primary Examiner*—Everette A. Powell, Jr.

*Attorney, Agent, or Firm*—Douglas S. Foote; Derek P. Lawrence

[57] ABSTRACT

A turbomachine seal for reducing fluid flow through the gap between circumferentially adjacent blade platforms is disclosed. The seal comprises a pair of radially inwardly extending elastomeric members. Each member has an inwardly extending first face and is bonded at a second face to respective ones of adjacent platforms. Each elastomeric member is circumferentially deflectable under a centrifugal load so that respective first faces meet.

7 Claims, 5 Drawing Figures

FAN BLADE PLATFORM SEAL

This invention relates generally to turbomachinery seals and, more particularly, to seals for reducing fluid flow through the gap between turbomachinery blade platforms.

BACKGROUND OF THE INVENTION

Turbomachinery, such as gas turbine engines, typically includes one or more rotatable assemblies with any number of rotatable blade rows. For example, certain aircraft gas turbine engines may include a fan for moving large volumes of air, thereby providing thrust. A typical fan structure includes a plurality of radially extending fan blades circumferentially offset from one another. Such fan blades may include a platform near the root portion thereof for defining the inner flow surface for air moving through the fan. In addition, the fan blades may be removably attached to a disk for ease of assembly and replacement of damaged blades.

A gap typically exists between adjacent blade platforms which may result in fan blade air loss therethrough if an appropriate seal is not provided. In the past, thin flexible seals between adjacent platforms have been occasionally used to seal these gaps. One side of the seal is attached to one of the blade platforms while the other side hangs loose under the gap so that when the fan starts to rotate, the seal is urged radially outwardly against the gap by centrifugal force, thereby providing an effective seal. For example, U.S. Pat. No. 4,183,720—Brantley, discloses such a seal.

While such seals may be generally effective, they may be unsatisfactory in certain applications. For example, certain fan blades, such as those which use a mid-span shroud, are removed from the disk by being dropped radially inwardly. This motion is necessary to disengage the mid-span shroud before further removing the blade. Similarly, other blading configurations exist which require radial motion of the blade during assembly and disassembly. Seals, such as those described above, interfere and restrict such blade motion and are generally unsuited for such applications.

OBJECTS OF THE INVENTION

It is an object of the present invention to provide a new and improved fan blade platform seal.

It is another object of the present invention to provide a flexible blade platform seal which is non-interfering during radial blade removal.

It is a further object of the present invention to provide a new and improved elastomeric seal which is circumferentially deflectable under a centrifugal load.

SUMMARY OF THE INVENTION

The present invention is a seal for reducing fluid flow through the gap between circumferentially adjacent blade platforms in a turbomachine. The seal comprises a pair of radially inwardly extending elastomeric members. Each member has an inwardly extending first face and is bonded at a second face to respective ones of adjacent platforms. Each member is circumferentially deflectable under a centrifugal load so that respective first faces meet.

DETAILED DESCRIPTION OF THE DRAWINGS

Figure 1:
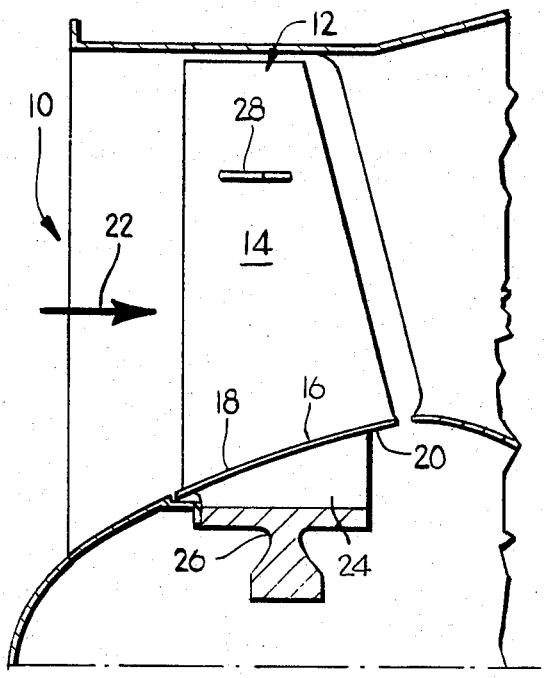
FIG. 1 shows a partial cross-sectional side view of a turbofan engine which embodies the present invention.

FIG. 1 shows a fan section 10 of a gas turbine engine. Although the invention described and illustrated herein is for a fan section of a gas turbine engine, it will be clear that it may apply equally to other blade rows in a turbomachine.

Fan section 10 includes a blade row or fan 12 with a plurality of radially extending, circumferentially spaced fan blades 14. Each blade 14 has a platform 16 connected thereto and which has an outer surface 18 and an inner surface 20. Outer surface 18 or platform 16 partially defines a surface for fluid 22 flowing thereover. Each blade 14 also includes a root 24 radially inwardly of platform 16 and which is removably mounted on a disk 26. Fan 12 also includes a mid-span shroud 28 which is formed by circumferentially extending pieces from opposite sides of each fan blade 14.

Figure 2:
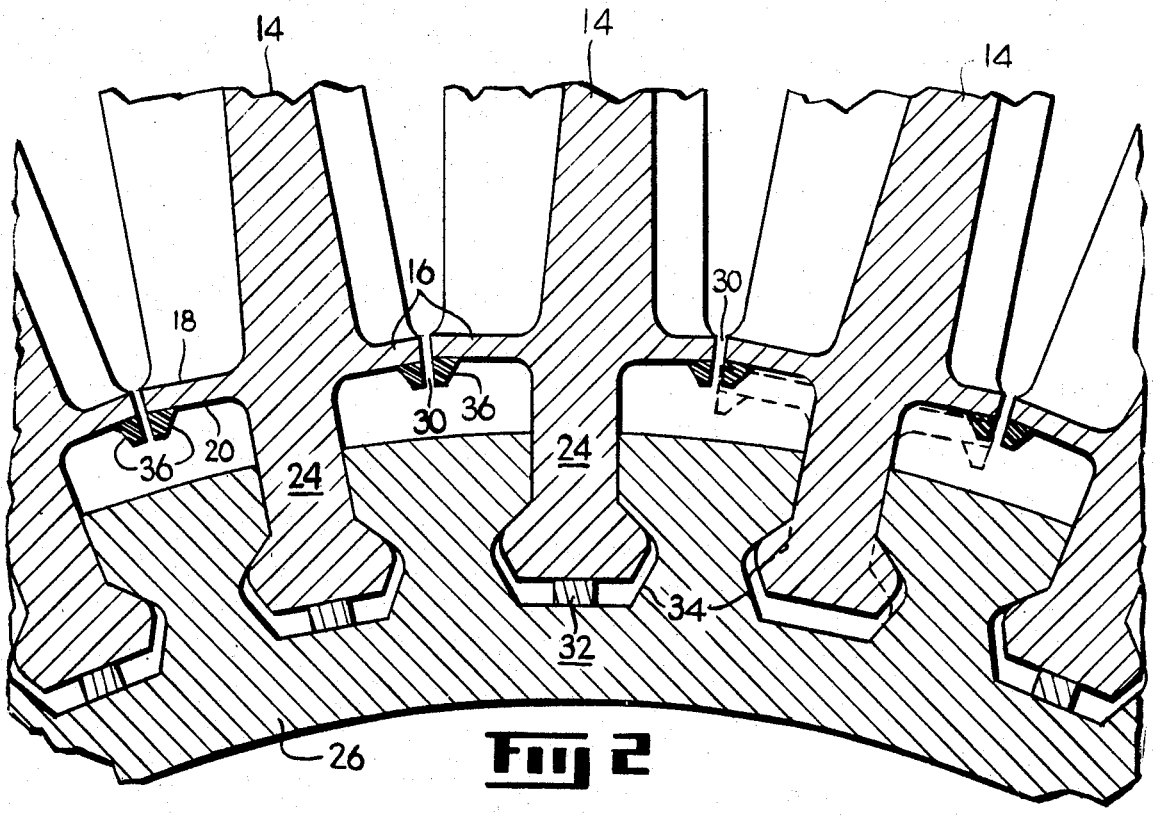
FIG. 2 is a partial front view of the fan blade row shown in FIG. 1.

FIG. 2 shows a partial front view of fan section 10. As shown therein, circumferentially adjacent blade platforms 16 are generally in alignment and are separated by a gap 30 therebetween. In order to remove a blade 14 from disk 26, it is first necessary to disengage mid-span shroud 28. In order to this, retention means 32 must be removed so that blade 14 may be dropped inwardly in a radial movement. Blade 14 may then be removed from disk 26 by sliding it axially out of dovetail 34.

Figure 3:
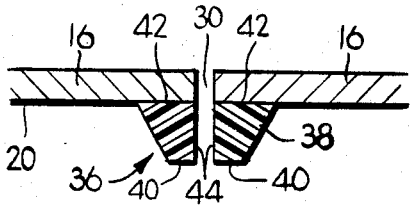
FIG. 3 is a fragmentary cross-sectional view of a seal according to the present invention.
Figure 4:
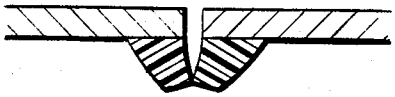
FIG. 4 is a view of the seal of FIG. 2 during engine operation.

Shown in FIG. 2, and in greater detail in FIG. 3, is a seal 36 which is effective for reducing fluid flow through gap 30. Seal 36 comprises a pair of radially inwardly extending elastomeric members 38. Each member 38 has an inwardly extending first face 40 and, opposite therefrom, a second face 42 bonded to inner surface 20 of platform 16. Each seal member 38 must be configured so as to be non-interferring during removal of blade 14 from disk 26. However, the configuration must permit circumferential deflection under a centrifugal load, such as occurs during engine operation, so that respective members 38 meet. For example, first faces 40 of respective members 38 may meet, as shown in FIG. 4. In this manner, a flow of fluid 22 through gap 30 will be reduced.

Figure 5:
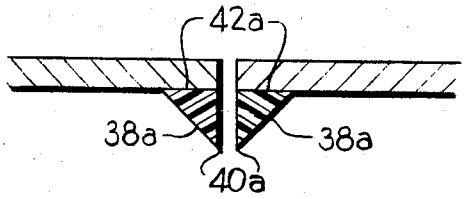
FIG. 5 is a view of a seal according to an alternative form of the present invention.

FIGS. 3 and 5 show alternative seal configurations. Each configuration will be circumferentially deflectable under a centrifugal load in a manner similar to that shown in FIG. 4. Each elastomeric member 38 in FIG. 3 has a generally trapezoidal cross section with first face 40 and second face 42 defining the bases thereof. Each member 38 also has an opposing third face 44. Each of these third faces defines a leg of the trapezoid. In a preferred embodiment, third face 44 substantially defines an altitude of the trapezoid.

In the embodiment shown in FIG. 5, each elastomeric member **38*a* has a generally triangular cross section with second face 42*a* defining one side thereof. Extending radially inwardly is a first face or edge 40*a* which forms an apex opposite side 42*a*. In a preferred embodiment of elastomeric member 38*a*, the cross section is generally right triangular with second edge 42***a* forming a leg thereof.

In operation, fan 12 rotates circumferentially creating centrifugal forces on blades 14 and seals 36. Seals 36 are configured, as described above, to respond to centrifugal loading by deflection circumferentially or laterally to reduce or close gap 30. In this manner, fan air fluid 22 flowing through fan 12 will not flow through gap 30 or be reduced therethrough resulting in increased efficiency of the engine system.

It will be clear to those skilled in the art that the present invention is not limited to the specific embodiments described and illustrated herein. Nor, is it limited to seals for fan blade platforms. Rather, it applies equally to other bladed rows in a turbomachine, such as compressor and turbine rows. Furthermore, the trapezoidal and triangular cross-sectional configurations of elastomeric members 38 and 38*a* are exemplary only and numerous alternative geometric configurations which produce the required circumferential movement are possible.

It will be understood that the dimensions and proportional structural relationships shown in the drawing are by way of example only, and these illustrations are not to be taken as the actual dimensions or proportional structural relatioship used in the seal of the present invention.

Numerous modifications, variations, and full and partial equivalents can now be undertaken without departing from the invention as limited only by the spirit and scope of the appended claims.

What is desired to be secured by Letters Patent of the United States is the following.

What is claimed is:

1. In a turbomachine, including a blade row with a plurality of radially extending and circumferentially spaced blades, each blade having a platform partially defining a surface for fluid flowing thereover, a seal for reducing fluid flow through the gap between circumferentially adjacent blade platforms comprising:

a pair of radially inwardly extending elastomeric members (38), each member having first and second generally opposite faces, the first face (40) being disposed radially inwardly of the second face (42), the second face (42) being bonded to the radially inner surface of its respective adjacent platform (16), wherein each member (38) is circumferentially deflectable under a centrifugal load so that respective first races (40) meet.

2. A seal, as recited in claim 1, where, in the absence of centrifugal loading, each elastomeric member (38) has a generally trapezoidal cross section with said first face (40) generally parallel to and opposite said second face (42) defining the bases thereof.

3. A seal, as recited in claim 2, wherein each of said elastomeric members (38) has a third face (44) opposite the respective third face (44) of the other member (38) and wherein each of said third faces (44) defines a leg of said trapezoid.

4. A seal, as recited in claim 2, wherein said third face (44) substantially defines an altitude of said trapezoid.

5. A seal, as recited in claim 1, where, in the absence of centrifugal loading, each elastomeric member (38*a*) has a generally triangular cross section with said second face (42*a*) defining one side thereof and said first face (40*a*) being an edge and forming the opposite apex from said side (42*a*).

6. A seal, as recited in claim 5, wherein said cross section is generally right triangular with said second edge (42*a*) forming a leg thereof.

7. An improvement for a gas turbine engine comprising:

a fan with a plurality of fan blades, each of said blades being removably mounted on a disk so that removal therefrom requires radial movement of said blade;

a platform connected to each of said blades and having an inner surface and an outer surface which partially defines a surface for fluid flowing thereover;

wherein adjacent blade platforms are generally in alignment and are separated by a gap therebetween; and a radially inwardly extending elastomeric member, said member having a generally triangular cross section and having a face which is bonded to said inner surface and being configured in a manner to be non-interfering during said blade removal, but to be circumferentially deflectable under a centrifugal load so that respective members of adjacent platforms meet and reduce fluid flow through said gap.

* * * * *